US007404753B2

(12) United States Patent
Cheng

(10) Patent No.: US 7,404,753 B2
(45) Date of Patent: Jul. 29, 2008

(54) ADJUSTABLE FASTENING ARRANGEMENT FOR GARMENT

(75) Inventor: Liza Cheng, Shenzhen (CN)

(73) Assignee: Embry (China) Garments Ltd., Shenzhen (CN)

( * ) Notice: Subject to any disclaimer, the term of this patent is extended or adjusted under 35 U.S.C. 154(b) by 511 days.

(21) Appl. No.: 11/088,558

(22) Filed: Mar. 23, 2005

(65) Prior Publication Data

US 2005/0260920 A1 Nov. 24, 2005

(30) Foreign Application Priority Data

May 20, 2004 (CN) ..... 2004 2 00462695

(51) Int. Cl.
*A41C 3/10* (2006.01)
*A41C 3/00* (2006.01)

(52) U.S. Cl. ..... 450/86; 24/171; 24/196; 450/63; 450/79; 450/1; 2/311; 2/321; 2/336

(58) Field of Classification Search ..... 450/1, 450/58, 63, 79, 80, 86, 88; 2/326, 327, 336, 2/305, 311, 312, 316, 317, 321, 322, 340
See application file for complete search history.

(56) References Cited

U.S. PATENT DOCUMENTS 2,924,865 A * 2/1960 Berning ..... 24/310
5,644,822 A * 7/1997 Frew ..... 24/196
6,994,606 B2 * 2/2006 Li ..... 450/82

* cited by examiner

*Primary Examiner*—Gloria Hale
(74) *Attorney, Agent, or Firm*—Raymond Y. Chan; David and Raymond Patent Firm

(57) ABSTRACT

An adjustable locking arrangement for a brassiere having two brassiere cups comprise two elongated straps, each of which has a free sliding end portion and an affixing end portion, a locking fastener, comprising a fastening body having two side opening and a center window, and two locker members slidably mounted on the fastening body at the center window, wherein the elongated straps are overlappedly tucked to form two locking loops to slidably engage with the fastening body through the side openings respectively for wrapping up two locker members. Therefore, once the two sliding end portions of the elongated straps are pulled opposedly, the two locker members are capable of defining a distance between the two brassiere cups, and when the affixing end portions of the elongated straps are pulled opposedly, two locker members are capable of locking up the distance.

20 Claims, 4 Drawing Sheets

ADJUSTABLE FASTENING ARRANGEMENT FOR GARMENT

BACKGROUND OF THE PRESENT INVENTION

1. Field of Invention

The present invention relates to a fastener, and more particularly to an adjustable fastener for garment such as brassiere and dress accessories.

2. Description of Related Arts

Nowadays, underwear such as brassiere is generally constructed to have two brassiere cups and a front fastener provided between the two brassiere cups such that the wearer is able to easily wear the brassier via the front fastener for enhancing the comfort of the brassiere. However, such front fastener cannot adjust a distance between the two brassiere cups to fit the brassiere on the wearer's body. Even though the brassiere contains an adjustable clip to adjust the loop size of the brassiere, such adjustable clip is inconvenient and cannot adjust the distance between the two brassiere cups. In addition, it is so complicated for the wearer to adjust the loop size of the brassiere via the adjustable clip to fit the brassiere cups on the wearer's body. With the marketing grows rapidly, it is a need of the brassiere with a buckle which can be easy to operate, reliable and a size-adjustable feature. The inventor of the present invention provides a "self-lock buckle with antiskid feature" in China Patent No. 0320118861.1 to adjust the size of the underwear. It is an improvement to solve the technical drawback and to enhance the operation of the fastener for the underwear.

SUMMARY OF THE PRESENT INVENTION

A main object of the present invention is to provide an adjustable fastener for a brassiere, wherein the adjustable fastener, having a self-locking and antiskid feature, can be easily operated to adjust a distance between the two brassiere cups to fit the wearer's body while being cost effective.

Accordingly, to achieve above mentioned objects, the present invention provides an adjustable locking arrangement for a brassiere having two brassiere cups, comprising two elongated straps and an adjustable fastener.

The two elongated straps are adapted for sidewardly extending from the brassiere cups respectively, wherein each of the elongated straps has a free sliding end portion and an affixing end portion adapted for securely extending from the respective brassiere cup.

The adjustable fastener comprises a fastening body having two side opening and a center window, and two locker members each having a locking edge. The two locker members are slidably mounted on the fastening body at the center window, wherein the elongated straps are overlappedly tucked to form two locking loops to slidably engage with said fastening body through the side openings respectively that the two locker members are positioned within the two locking loops respectively, such that when the two sliding end portions of the elongated straps are pulled opposedly, the two locker members are slid inwardly and opposedly for selectively adjusting a distance between the two brassiere cups, and when the affixing end portions of the elongated straps are pulled opposedly, the two locker members are slid outwardly and opposedly to securely engage said locking edge with said elongated straps respectively to lock up the elongated straps at the fastening body for securely retaining the distance between the two brassiere cups.

The present invention allows the wearer to adjust a distance between the two brassiere cups via the adjustable fastener to fit the brassiere on the wearer's body such that the wearer is able to adjust the size of the brassiere according to the body shape and needs to keep the aesthetic appearance and comfort of the brassiere.

These and other objectives, features, and advantages of the present invention will become apparent from the following detailed description, the accompanying drawings, and the appended claims.

DETAILED DESCRIPTION OF THE PREFERRED EMBODIMENT

Referring to the FIGS. 1 to 4, an adjustable locking arrangement for a brassiere 7 having two brassiere cups is illustrated. According to the preferred embodiment, the brassiere 7 comprises two elongated straps 6 sidewardly extending from the brassiere cups respectively, wherein each of the elongated straps 6 has a free sliding end portion (i.e. the position A in FIG. 2) and an affixing end portion (i.e. the position B in FIG. 2) securely extending from the respective brassiere cup.

Figure 1:
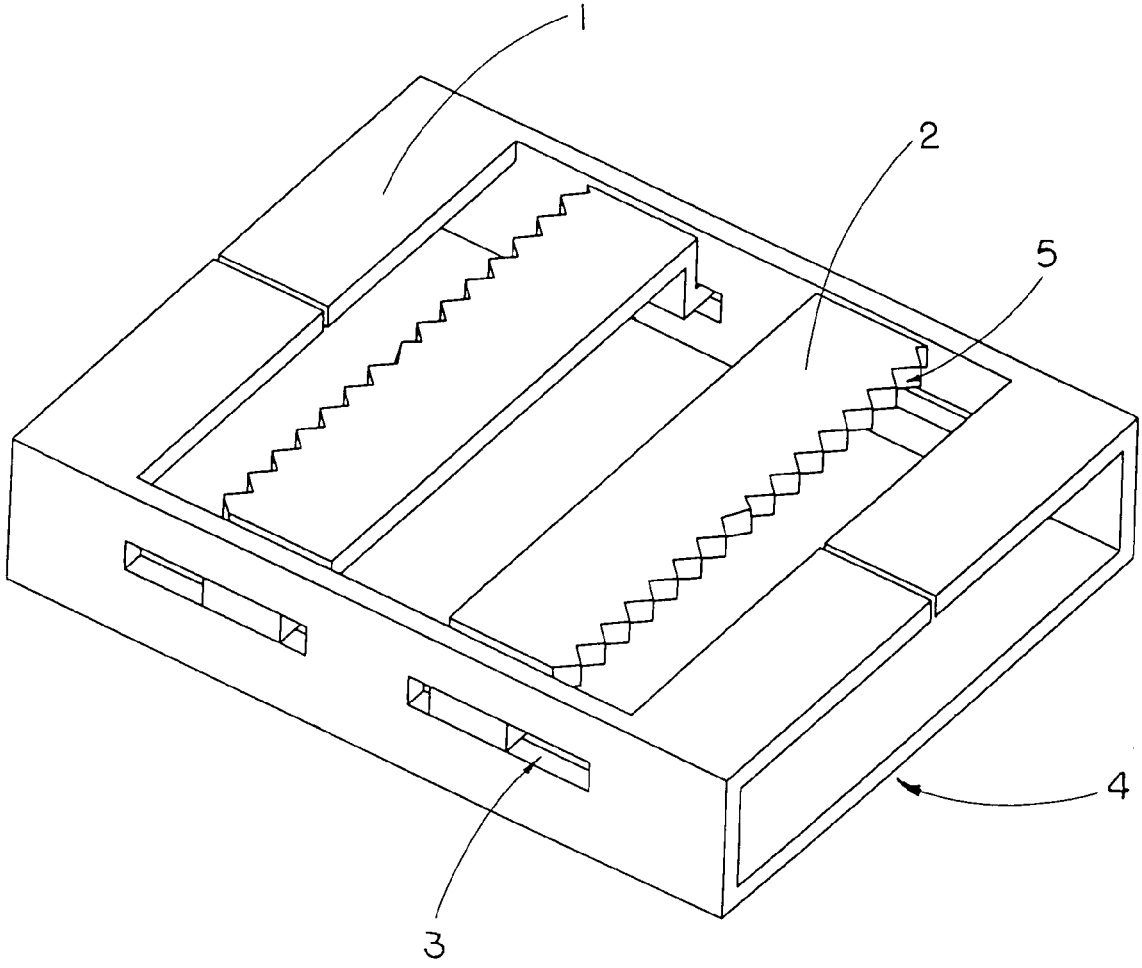
FIG. 1 is a perspective view of an adjustable fastener of an adjustable fastening arrangement according to a preferred embodiment of the present invention.

The adjustable locking arrangement comprises an adjustable fastener and two locker members 2, wherein the adjustable fastener comprises a fastening body 1, having a rectangular shape, made of durable material such as metal or plastic via punching or casting process. The fastening body I has two side opening and a center window. The two locker members 2, each of which has a locking edge 5, are slidably mounted on the fastening body 1 at the center window of the adjustable fastener, wherein the elongated straps 6 are overlappedly tucked to form two locking loops to slidably engage with the fastening body I through the side openings respectively so that two locker members 2 are positioned within two locking loops respectively. The fastening body 1 further has two pairs of sliding slots 3 spacedly formed on two opposed walls of the fastening body 1, wherein two end portions of each of the locker members 2 are slidably engaged with the respective pair of sliding slots 3 to slidably mount the locker member 2 on the fastening body 1 at the center window thereof. Each of the locker members 2 has a shouldering edge formed at an opposed side of the locking edge 5 of the locker member 2 for slidably engaging with the respective elongated strap 6. In other words, the locking edge 5 and the shouldering edge are two longitudinal edges of the locker member 2. As shown in FIG. 1, the locking edge 5 is embodied as a teeth shaped edge to substantially engage with the elongated strap 6 and the shouldering edge is embodied as a smooth edge. Accordingly, the locking edge 5 and the shouldering edge can be embodied as two smooth edges for the respective elongated strap 6 sliding thereon. For enhancing the aesthetic appearance of the brassiere 7, the upper surface 4 of the fastening body 1 is designed as a smooth surface or printed with color pattern. Likewise, a decorative element 8 can be mounted on the upper surface 4 of the fastening body 1 to enclose the center window to achieve the decorative effect of the fastening body 1 for the brassiere 7.

Figure 2:
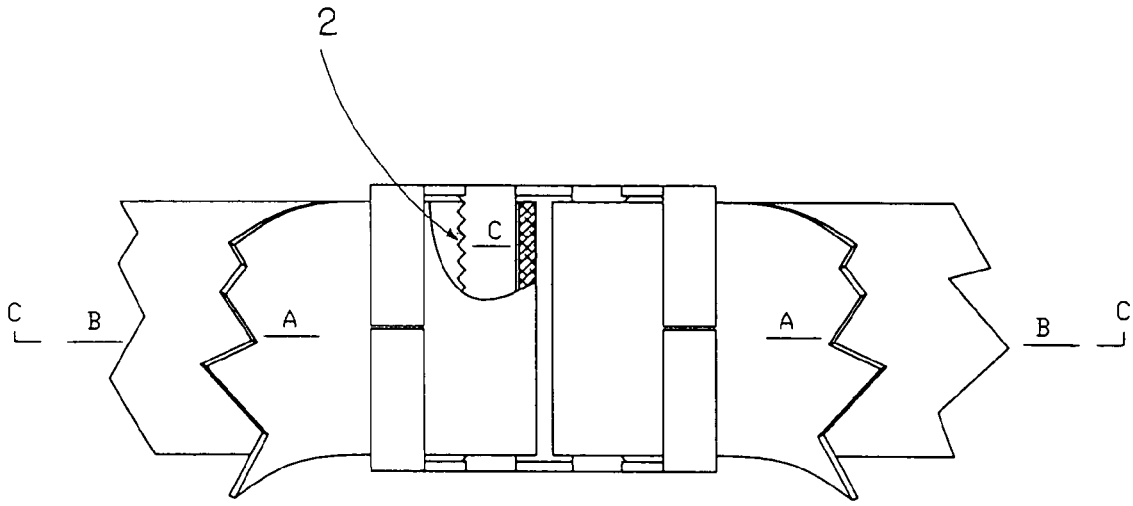
FIG. 2 is a perspective view of the adjustable fastener according to the above preferred embodiment of the present invention, illustrating the straps being slidably inserted into the adjustable fastener.
Figure 3:
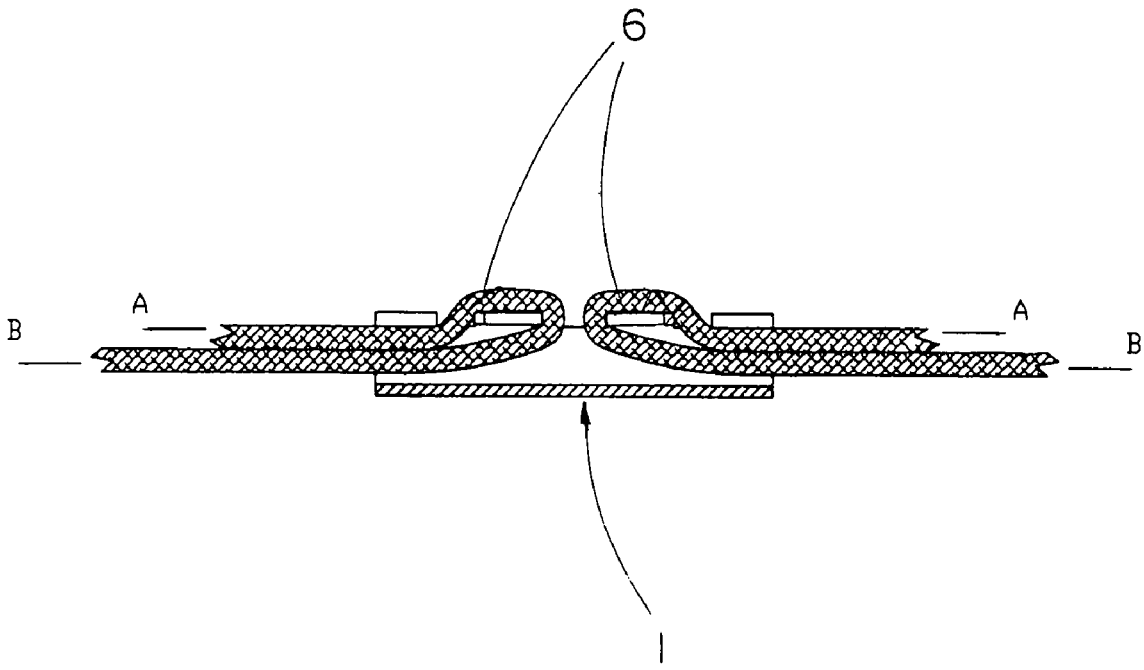
FIG. 3 is a sectional view of the adjustable fastening arrangement according to the above preferred embodiment of the present invention.
Figure 4:
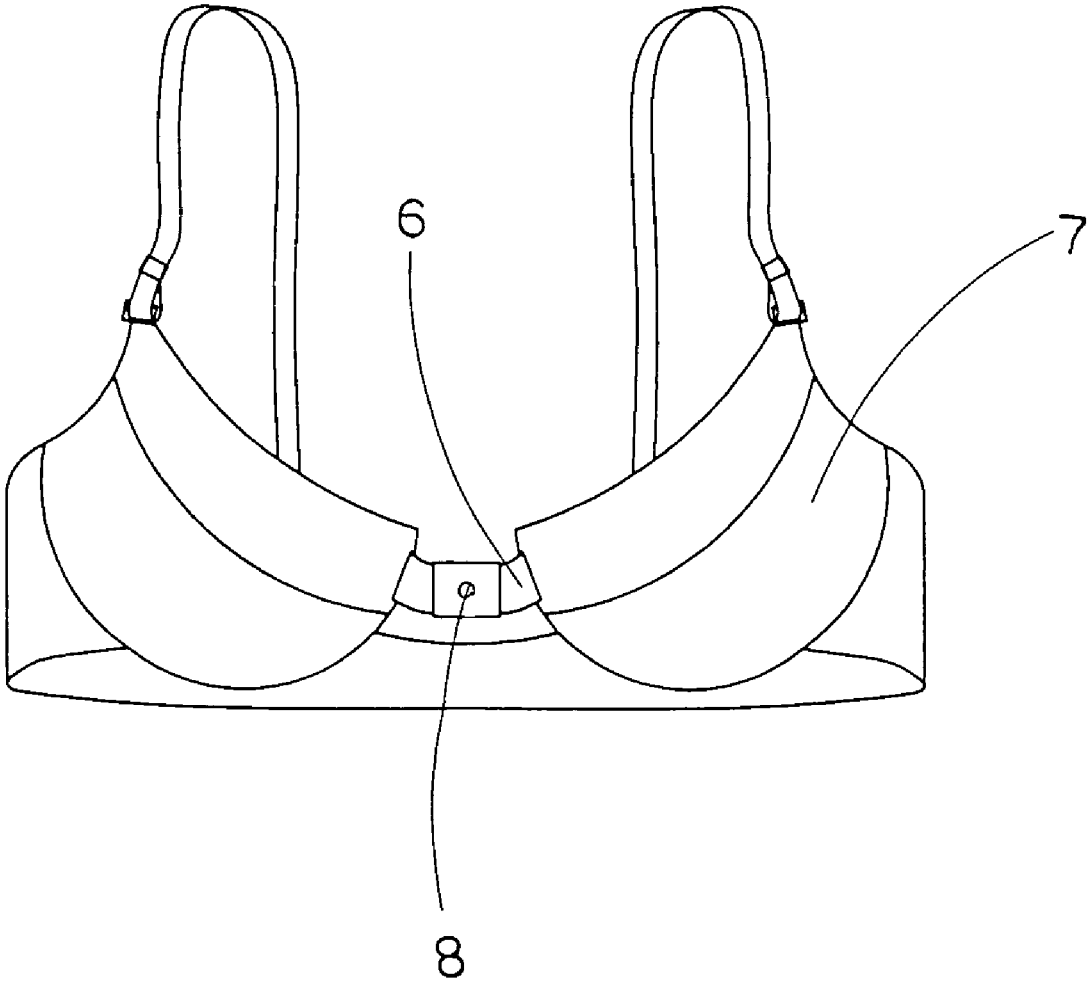
FIG. 4 is a perspective view of the adjustable fastening arrangement incorporating with a brassiere according to the preferred embodiment of the present invention.

For incorporating the adjustable fastener with the brassiere 7, as shown in FIGS. 2 to 4, the adjustable locking arrangement is adapted to secure the two brassiere cups in position and to selectively adjust the distance between the two brassiere cups. When the two sliding end portions (position A) of the elongated straps 6 are pulled opposedly, the two locker members 2 are slid inwardly and opposedly (at the opposite direction of C) for selectively adjusting the distance between the two brassiere cups. When the affixing end portions (position B) of the elongated straps 6 are pulled opposedly, the two locker members 2 are slid outwardly and opposedly (at the direction of C) to securely engage the locking edge 5 of the two locker members 2 with the elongated straps respectively to lock up the elongated straps at the fastening body 1 for securely retaining the distance between the two brassiere cups. It is worth to mention that the teeth-shaped locking edge 5 of the locker member 2 is substantially engaged with the elongated strap 6 to securely lock up the elongated strap 6 at the fastening body 1 by the pulling tension of the elongated strap 6. Therefore, once the elongated strap 6 is tightened up, the locker member 2 is self-locked up with the fastening body 1 to prevent the elongated strap 6 from being skid along the fastening body 1. In other words, the adjustable fastener provides an anti-skid feature to prevent an unwanted skidding movement of the elongated strap 6 with respect to the fastening body 1. Therefore, once the distance between the two brassiere cup is adjusted corresponding to the body size of the wearer by pulling the two sliding end portions of the elongated straps 6, the adjustable fastener locks up the distance by pulling the affixing end portions of the elongated straps 6. As shown in FIG. 4, since the adjustable fastener of the present invention provides at a front side of the brassiere for coupling the two brassiere cups, the adjustable locking arrangement is adapted to selectively adjust the distance between the two brassiere cups and further lock up the two brassiere cups at a desired distance according to the body shape of the wearer. It is worth to mention that the decorative element 8 can be mounted at the upper surface 4 of the fastener body 1 to cover the center window of the fastening body 1 so as to provide aesthetic effect of the brassiere. In other words, compared with conventional front fastener of brassiere, the adjustable fastener of the present invention not only provides build-in locking mechanism but also collaborates with decorative element so as to enable a multiple functions.

What is claimed is:

1. A brassiere, comprising:

two brassiere cups;

two elongated straps each one of said two straps is sidewardly extending from said brassiere cups respectively, wherein each one of said elongated straps has a free sliding end portion and an affixing end portion securely extending from each of said respective brassiere cup; and a locking fastener, which comprises:

a fastening body having two side openings and a center window; and two locker members, each having a locking edge, slidably mounted on said fastening body at said center window, wherein said elongated straps are overlappedly tucked to form two locking loops to slidably engage with said fastening body through said side openings respectively that said two locker members are positioned within said two locking loops respectively, such that when said two sliding end portions of said elongated straps are pulled opposedly, said two locker members are slid inwardly and opposedly to selectively adjust a distance between said two brassiere cups, and when said affixing end portions of said elongated straps are pulled opposedly, said two locker members are slid outwardly and opposedly to securely engage said locking edge with said elongated straps respectively to lock up said elongated straps at said fastening body for securely retaining said distance between said two brassiere cups.

2. The brassiere, as recited in claim 1, wherein said locking edge of each of said locker members is embodied as a teeth shaped edge to substantially engage with said elongated strap.

3. The brassiere, as recited in claim 1, wherein each of said locker members has a shouldering edge formed at an opposed side of said locking edge of said locker member for slidably engaging with said respective elongated strap, wherein said shouldering edge is embodied as a smooth edge.

4. The brassiere, as recited in claim 2, wherein each of said locker members has a shouldering edge formed at an opposed side of said locking edge of said locker member for slidably engaging with said respective elongated strap, wherein said shouldering edge is embodied as a smooth edge.

5. The brassiere, as recited in claim 1, wherein said fastening body further has two pairs of sliding slots spacedly formed on two opposed walls of said fastening body, wherein two end portions of each of said locker members are slidably engaged with said respective pair of sliding slots to slidably mount said locker member on said fastening body at said center window thereof.

6. The brassiere, as recited in claim 2, wherein said fastening body further has two pairs of sliding slots spacedly formed on two opposed walls of said fastening body, wherein two end portions of each of said locker members are slidably engaged with said respective pair of sliding slots to slidably mount said locker member on said fastening body at said center window thereof.

7. The brassiere, as recited in claim 4, wherein said fastening body further has two pairs of sliding slots spacedly formed on two opposed walls of said fastening body, wherein two end portions of each of said locker members are slidably engaged with said respective pair of sliding slots to slidably mount said locker member on said fastening body at said center window thereof.

8. The brassiere, as recited in claim 1, further comprising a decorative element mounted on said fastener body to cover said center window thereof.

9. The brassiere, as recited in claim 4, further comprising a decorative element mounted on said fastener body to cover said center window thereof.

10. The brassiere, as recited in claim 7, further comprising a decorative element mounted on said fastener body to cover said center window thereof.

11. An adjustable locking fastener for a brassiere having two brassiere cups and two elongated straps each of which having an affixing end portion extending from said respective brassiere cup and a free sliding end portion overlappedly tucked to form two locking loops, wherein said adjustable locking fastener comprises:

a fastening body having a center window and two side opening for said elongated straps slidably inserting therethrough respectively; and two locker members, each having a locking edge, slidably mounted on said fastening body at said center window, wherein said locker members are positioned within said two locking loops respectively, thereby, when said two sliding end portions of said elongated straps are pulled opposedly, said two locker members are slid inwardly and opposedly to selectively adjust a distance between said two brassiere cups, and when said affixing end portions of said elongated straps are pulled opposedly, said two locker members are slid outwardly and opposedly to securely engage said locking edge with said elongated straps respectively to lock up said elongated straps at said fastening body for securely retaining said distance between said two brassiere cups.

12. The adjustable locking fastener, as recited in claim 11, wherein said locking edge of each of said locker member is embodied as a teeth shaped edge to substantially engage with said elongated strap.

13. The adjustable locking fastener, as recited in claim 11, wherein each of said locker members has a shouldering edge formed at an opposed side of said locking edge of said locker member for slidably engaging with said respective elongated strap, wherein said shouldering edge is embodied as a smooth edge.

14. The adjustable locking fastener, as recited in claim 12, wherein each of said locker members has a shouldering edge formed at an opposed side of said locking edge of said locker member for slidably engaging with said respective elongated strap, wherein said shouldering edge is embodied as a smooth edge.

15. The adjustable locking fastener, as recited in claim 11, wherein said fastening body further has two pairs of sliding slots spacedly formed on two opposed walls of said fastening body, wherein two end portions of each of said locker members are slidably engaged with said respective pair of sliding slots to slidably mount said locker member on said fastening body at said center window thereof.

16. The adjustable locking fastener, as recited in claim 12, wherein said fastening body further has two pairs of sliding slots spacedly formed on two opposed walls of said fastening body, wherein two end portions of each of said locker members are slidably engaged with said respective pair of sliding slots to slidably mount said locker member on said fastening body at said center window thereof.

17. The adjustable locking fastener, as recited in claim 14, wherein said fastening body further has two pairs of sliding slots spacedly formed on two opposed walls of said fastening body, wherein two end portions of each of said locker members are slidably engaged with said respective pair of sliding slots to slidably mount said locker member on said fastening body at said center window thereof.

18. The adjustable locking fastener, as recited in claim 11, further comprising a decorative element mounted on said fastener body to cover said center window thereof.

19. The adjustable locking fastener, as recited in claim 14, further comprising a decorative element mounted on said fastener body to cover said center window thereof.

20. The adjustable locking fastener, as recited in claim 17, further comprising a decorative element mounted on said fastener body to cover said center window thereof.

* * * * *